US011183094B2

(12) United States Patent
Tsai et al.

(10) Patent No.: US 11,183,094 B2
(45) Date of Patent: Nov. 23, 2021

(54) ELECTRONIC DEVICE

(71) Applicant: InnoLux Corporation, Miao-Li County (TW)

(72) Inventors: Chia-Hao Tsai, Miao-Li County (TW); Yi-Shiuan Cherng, Miao-Li County (TW); Yung-Hsun Wu, Miao-Li County (TW)

(73) Assignee: InnoLux Corporation, Miao-Li County (TW)

( * ) Notice: Subject to any disclaimer, the term of this patent is extended or adjusted under 35 U.S.C. 154(b) by 0 days.

(21) Appl. No.: 16/823,302

(22) Filed: Mar. 18, 2020

(65) Prior Publication Data

US 2020/0327837 A1 Oct. 15, 2020

Related U.S. Application Data

(60) Provisional application No. 62/833,805, filed on Apr. 15, 2019.

(30) Foreign Application Priority Data

Dec. 5, 2019 (CN) ..... 201911234474.1

(51) Int. Cl.
*G09G 3/20* (2006.01)

(52) U.S. Cl.
CPC ..... *G09G 3/20* (2013.01); *G09G 2310/0267* (2013.01); *G09G 2310/0275* (2013.01); *G09G 2310/0286* (2013.01); *G09G 2310/0297* (2013.01); *G09G 2310/08* (2013.01)

(58) Field of Classification Search
CPC .... G09G 3/2003; G09G 3/3414; G09G 5/006; G09G 5/02; G09G 5/022
See application file for complete search history.

(56) References Cited

U.S. PATENT DOCUMENTS 8,284,368 B2 * 10/2012 Liao ..... G09G 3/3614 349/144
2005/0200591 A1 * 9/2005 Satoh ..... G09G 3/3677 345/103
2016/0170273 A1 6/2016 Lee
2018/0174507 A1 * 6/2018 Ohara ..... G09G 3/325
2018/0315801 A1 * 11/2018 Matsueda ..... H01L 27/3218

FOREIGN PATENT DOCUMENTS

CN 104464602 A 3/2015

* cited by examiner

*Primary Examiner* — Kevin M Nguyen
(74) *Attorney, Agent, or Firm* — Winston Hsu

(57) ABSTRACT

An electronic device includes a data line, a plurality of first scan lines, a plurality of first sub pixels, and a plurality of second sub pixels. The data line transmits a plurality of data signals. The plurality of first scan lines intersect the data line and transmit a plurality of first scan signals. The plurality of first sub pixels are coupled to the data line, and configured to emit first color light. The plurality of second sub pixels are coupled to the data line and configured to emit second color light different from the first color light. At least two of the plurality of first sub pixels receive at least two of the plurality of data signals successively according to at least two of the plurality of first scan signals.

13 Claims, 14 Drawing Sheets

ELECTRONIC DEVICE

CROSS REFERENCE TO RELATED APPLICATION

This non-provisional application claims priority of U.S. provisional application No. 62/833,805, filed on Apr. 15, 2019, included herein by reference in its entirety.

BACKGROUND OF THE DISCLOSURE

1. Field of the Disclosure

The present disclosure is related to an electronic device, and more particular to an electronic device capable of reducing the area of the circuits in the peripheral region in a panel of the electronic device.

2. Description of the Prior Art

As the technologies of smartphone and internet develop, the functions of smartphones are becoming more and more powerful, which even changes the daily lives of human beings.

In today's consumer electronic products, in order to increase the proportion of the display area in a panel of an electronic device, it is critical to reduce the area of the peripheral region around the display area.

SUMMARY OF THE DISCLOSURE

One embodiment of the present disclosure discloses an electronic device. The electronic device includes a data line, a plurality of first scan lines, a plurality of first sub pixels, and a plurality of second sub pixels.

The data line transmits a plurality of data signals. The plurality of first scan lines intersect the data line and transmit a plurality of first scan signals. The plurality of first sub pixels are coupled to the data line and emit first color light. The plurality of second sub pixels are coupled to the data line and emit second color light different from the first color light.

At least two of the plurality of first sub pixels receive at least two of the plurality of data signals successively according to at least two of the plurality of first scan signals.

These and other objectives of the present disclosure will no doubt become obvious to those of ordinary skill in the art after reading the following detailed description of the embodiment that is illustrated in the various figures and drawings.

DETAILED DESCRIPTION

Figure 1:
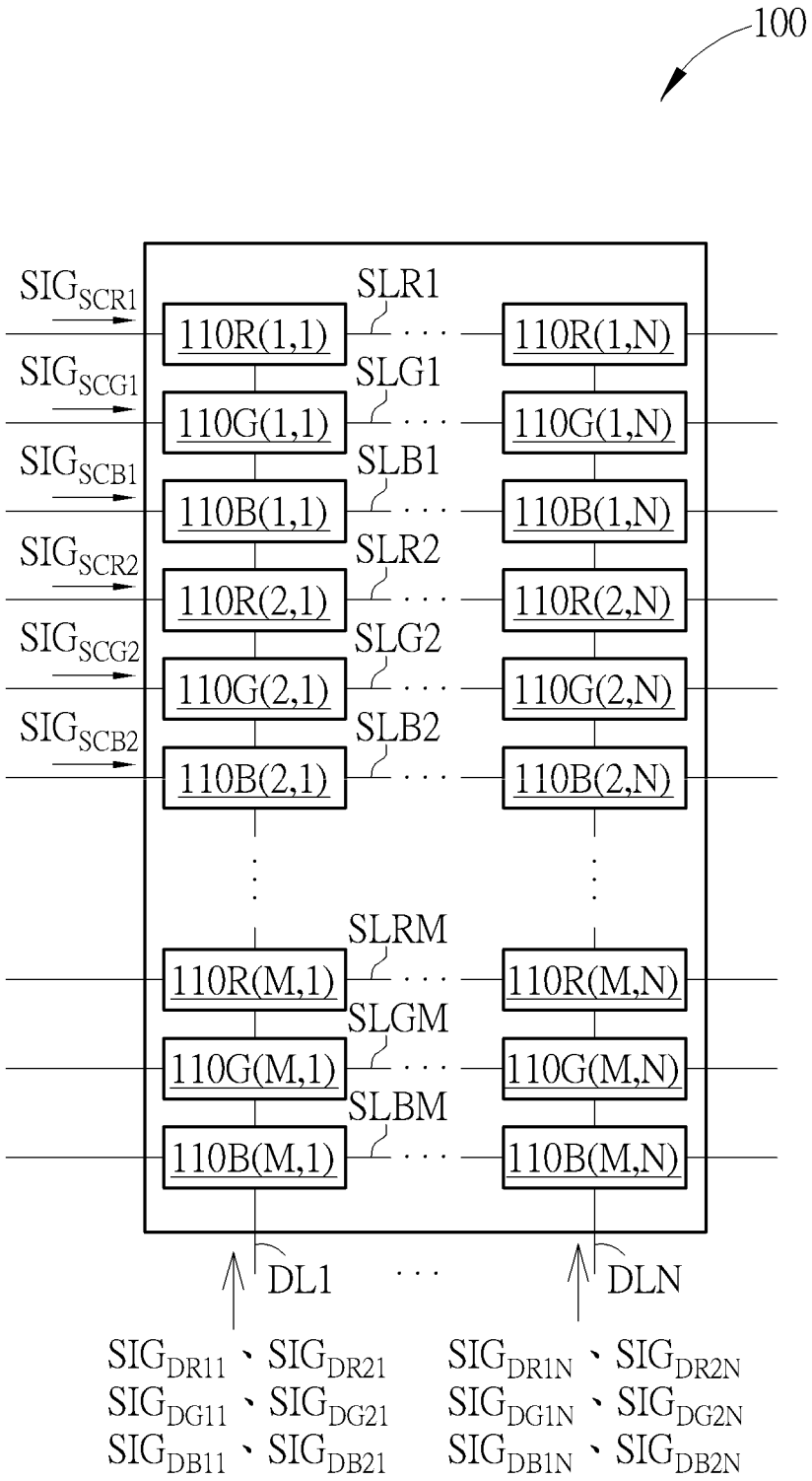
FIG. 1 shows a schematic diagram of an electronic device according to one embodiment of the present disclosure.

The electronics device of the present disclosure are described in detail in the following description. For purposes of explanation, numerous specific details and embodiments are set forth in order to provide a thorough understanding of the present disclosure. It will be apparent, however, that the exemplary embodiments set forth herein are used merely for the purpose of illustration, and the inventive concept may be embodied in various forms without being limited to those exemplary embodiments. In addition, the drawings of different embodiments may use like and/or corresponding numerals to denote like and/or corresponding elements in order to clearly describe the present disclosure. However, the use of like and/or corresponding numerals in the drawings of different embodiments does not suggest any correlation between different embodiments.

It should be noted that the elements or devices in the drawings of the present disclosure may be present in any form or configuration known to those with ordinary skill in the art. In addition, the expressions "a layer overlying another layer", "a layer is disposed above another layer", "a layer is disposed on another layer" and "a layer is disposed over another layer" may indicate that the layer is in direct contact with the other layer, or that the layer is not in direct contact with the other layer, there being one or more intermediate layers disposed between the layer and the other layer.

In addition, in this specification, relative expressions are used. For example, "lower", "bottom", "higher" or "top" are used to describe the position of one element relative to another. It should be appreciated that if a device is flipped upside down, an element that is "lower" will become an element that is "higher".

It should be understood that, although the terms first, second, third etc. may be used herein to describe various elements, components, regions, layers, portions and/or sections, these elements, components, regions, layers, portions and/or sections should not be limited by these terms. These terms are only used to distinguish one element, component, region, layer, portion or section from another element, component, region, layer or section. Thus, a first element, component, region, layer, portion or section discussed below could be termed a second element, component, region, layer, portion or section without departing from the teachings of the present disclosure.

It should be understood that this description of the exemplary embodiments is intended to be read in connection with the accompanying drawings, which are to be considered part of the entire written description. The drawings are not drawn to scale. In addition, structures and devices are shown schematically in order to simplify the drawing.

The terms "about" and "substantially" typically mean+/−20% of the stated value, more typically +/−10% of the stated value, more typically +/−5% of the stated value, more typically +/−3% of the stated value, more typically +/−2% of the stated value, more typically +/−1% of the stated value and even more typically +/−0.5% of the stated value. The stated value of the present disclosure is an approximate value. When there is no specific description, the stated value includes the meaning of "about" or "substantially".

Unless defined otherwise, all technical and scientific terms used herein have the same meaning as commonly understood by one of ordinary skill in the art to which this disclosure belongs. It should be appreciated that, in each case, the term, which is defined in a commonly used dictionary, should be interpreted as having a meaning that conforms to the relative skills of the present disclosure and the background or the context of the present disclosure, and should not be interpreted in an idealized or overly formal manner unless so defined.

In addition, in some embodiments of the present disclosure, terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

In the present disclosure, the electronic device can include a display device, a light source device, a backlight device, and sensing device, an antenna device, or a tiled electronic device, but the present disclosure is not limited thereto. The electronic device can be a bendable of flexible electronic device. The electronic device can include liquid crystal or light emitting diode, the light emitting diode can, for example, include inorganic light emitting diode (LED), organic light emitting diode (OLED), mini LED, micro LED, quantum dot LED (QLED or QDLED), fluorescence, phosphor, other suitable materials, or the combination thereof. The tiled electronic device can include a tiled display device, a tiled light source device, or a tiled antenna device, but the present disclosure is not limited thereto. It should be noted that the electronic device may be an arbitrary combination of aforementioned devices. To describe more easily, a display device with a display panel is utilized as a example to describe the present disclosure, but the present disclosure is not limited thereto. Furthermore, the electronic device may be used in televisions, tablet PCs, notebook PCs, mobile phones, cameras, wearable devices, electronic entertainment device, liquid crystal antennas, etc., but the present disclosure is not limited thereto.

FIG. 1 shows a schematic diagram of an electronic device 100 according to one embodiment of the present disclosure. In the present embodiment, the electronic device 100 includes data lines DL1 to DLN, first scan lines SLR1 to SLRM, second scan lines SLG1 to SLGM, third scan lines SLB1 to SLBM, first sub pixels 110R(1,1) to 110R(M,N), second sub pixels 110G(1,1) to 110G(M,N), and third sub pixels 110B(1,1) to 110B(M,N), where M and N are integers greater than 1 respectively. The first sub pixels 110R(1,1) to 110R(M,N) can emit first color light, the second sub pixels 110G(1,1) to 110G(M,N) can emit second color light, and the third sub pixels 110B(1,1) to 110B(M,N) can emit third color light. In some embodiments, the first color light, the second color light and the third color light can be of different colors. For example, the first color light can be red light, the second color light can be green light, and the third color light can be blue light. In some other embodiments, the first color light, the second color light, and the third color light can be of some other colors, and the electronic device 100 can further include sub pixels emitting different color light, such as sub pixels emitting white light or sub pixels emitting yellow light. Or, in some embodiments, the electronic device 100 may include sub pixels emitting light of only two different colors.

In addition, the first scan lines SLR1 to SLRM, the second scan lines SLG1 to SLGM, and the third scan lines SLB1 to SLBM intersects the data lines DL1 to DLN. For example, in FIG. 1, the extension direction(s) of the first scan lines SLR1 to SLRM, the second scan lines SLG1 to SLGM, and the third scan lines SLB1 to SLBM can be different from the extension direction of the data lines DL1 to DLN. In some embodiments, the extension direction of the first scan lines SLR1 to SLRM, the second scan lines SLG1 to SLGM, and the third scan lines SLB1 to SLBM can be perpendicular to the extension direction of the data lines DL1 to DLN.

In FIG. 1, the first sub pixels 110R(1,1) to 110R(M,N) can be arranged into a plurality of rows sequentially, the second sub pixels 110G(1,1) to 110G(M,N) can be arranged into a plurality of rows sequentially, and the third sub pixels 110B(1,1) to 110B(M,N) can be arranged into a plurality of rows sequentially. Furthermore, in the same column, the first sub pixels, the second sub pixels, and the third sub pixels can be arranged in a staggered manner. For example, the first sub pixel 110R(1,1), the second sub pixel 110G(1,1), the third sub pixel 110B(1,1), the first sub pixel 110R(2,1), the second sub pixel 110G(2,1), the third sub pixel 110B(2,1) can be disposed sequentially in the same column. In some embodiments, the first sub pixel 110R(1,1), the second sub pixel 110G(1,1), the third sub pixel 110B(1,1) can be corresponding to the same pixel, and the first sub pixel 110R(2,1), the second sub pixel 110G(2,1), the third sub pixel 110B(2,1) can be corresponding to another pixel. However, the arrangement shown in FIG. 1 is only one example of the present disclosure, in some other embodiments, the sub pixels can be arranged in different manners according to the system requirements.

In some embodiments, the first sub pixels 110R(1,1) to 110R(1,N) disposed in the same row can be coupled to the same first scan line SLR1, and can be coupled to the data lines DL1 to DLN respectively. Therefore, when the first scan line SLR1 transmits the first scan signal $SIG_{SCR1}$, the first sub pixels 110R(1,1) to 110R(1,N) will receive the data signals $SIG_{DR11}$ to $SIG_{DR1N}$ from the data lines DL1 to DLN respectively. Similarly, the second sub pixels 110G(1,1) to 110G(1,N) disposed in the other row can be coupled to the second scan line SLG1, and can be coupled to the data lines DL1 to DLN respectively. Also, the third sub pixels 110B(1,1) to 110B(1,N) disposed in another row can be coupled to the third scan line SLB1, and can be coupled to the data lines DL1 to DLN respectively.

In this case, the first scan line SLR1, the second scan line SLG1, and the third scan line SLB1 can transmit the first scan signal $SIG_{SCR1}$, the second scan signal $SIG_{SCG1}$, and the third scan signal $SIG_{SCB1}$ at different periods, and the data lines DL1 to DLN will transmit the data signals for the corresponding color light in the corresponding periods. For example, when the first sub pixel 110R(1,1) receives the first scan signal $SIG_{SCR1}$, the data line DL1 will transmit the data signal $SIG_{DR11}$ for the first sub pixel 110R(1,1). Also, when the second sub pixel 110G(1,1) receives the second scan signal $SIG_{SCG1}$, the data line DL1 will transmit the data signal $SIG_{DG11}$ for the second sub pixel 110G(1,1).

That is, sub pixels emitting different color light can be coupled to the same data line; therefore, the electronic device 100 can be manufactured with less data lines, thereby reducing the area of the required circuits in the peripheral region in a panel of the electronic device 100.

However, if the data line DL1 transmits the data signals for different color light sequentially, for example, if the data signals $SIG_{DR11}$, $SIG_{DG11}$, and $SIG_{DB11}$ are transmitted sequentially, the voltage of the data line DL1 will be changed more frequently, causing large power consumption.

Generally, since the variation of color in a small area is usually smooth and inconspicuous, the data signals received by the sub pixels of the same color within a small region often have relatively similar values. Furthermore, when presenting an image of one pure color, although the data signals received by sub pixels of different colors may have different values, the data signals received by the sub pixels of the same color may have the same value. Therefore, in some embodiments, if the data lines DL1 to DLN can transmit at least two data signals of the same color successively, then the amount and the frequency of the voltage change on the data lines DL1 to DLN can be reduced, thereby reducing power consumption.

For example, in FIG. 1, the data line DL1 can transmit two data signals $SIG_{DR11}$ and $SIG_{DR21}$ for the red color light successively, and the first sub pixels 110R(1,1) and 110R(2,1) will receive the data signals $SIG_{DR11}$ and $SIG_{DR21}$ successively according to the first scan signals $SIG_{SCR1}$ and $SIG_{SCR2}$. Next, the data line DL1 can transmit two data signals $SIG_{DG11}$ and $SIG_{DG21}$ for the green color light successively, and the second sub pixels 110G(1,1) and 110G(2,1) will receive the data signals $SIG_{DG11}$ and $SIG_{DG21}$ successively according to the second scan signals $SIG_{SCG1}$ and $SIG_{SCG2}$. After the data signals $SIG_{DG11}$ and $SIG_{DG21}$ are transmitted, the data line DL1 can transmit two data signals $SIG_{DB11}$ and $SIG_{DB21}$ for the blue color light successively, and the third sub pixels 110B(1,1) and 110B(2,1) will receive the data signals $SIG_{DB11}$ and $SIG_{DB21}$ successively according to the third scan signals $SIG_{SCB1}$ and $SIG_{SCB2}$. Also, After the data signals $SIG_{DB11}$ and $SIG_{DB21}$ are transmitted, the data line DL1 can keep transmitting two data signals for the red color light successively, and so on. Similarly, the data line DLN can transmit the data signals $SIG_{DR1N}$, $SIG_{DR2N}$, $SIG_{DG1N}$, $SIG_{DG2N}$, $SIG_{DB1N}$, $SIG_{DB2N}$ sequentially to the first sub pixels 110R(1,N), 110R(2,N), the second sub pixels 110G(1,N) and 110G(2,N), and the third sub pixels 110B(1,N) and 110B(2,N) respectively.

That is, in the present disclosure, each data line can be coupled to multiple first sub pixels and can transmit multiple data signals. At least two of these first sub pixels can receive at least two data signals of these data signals successively according to at least two first scan signals. In some embodiments, at least three first sub pixels can receive at least three data signals successively according to at least three first scan signals.

Figure 2:
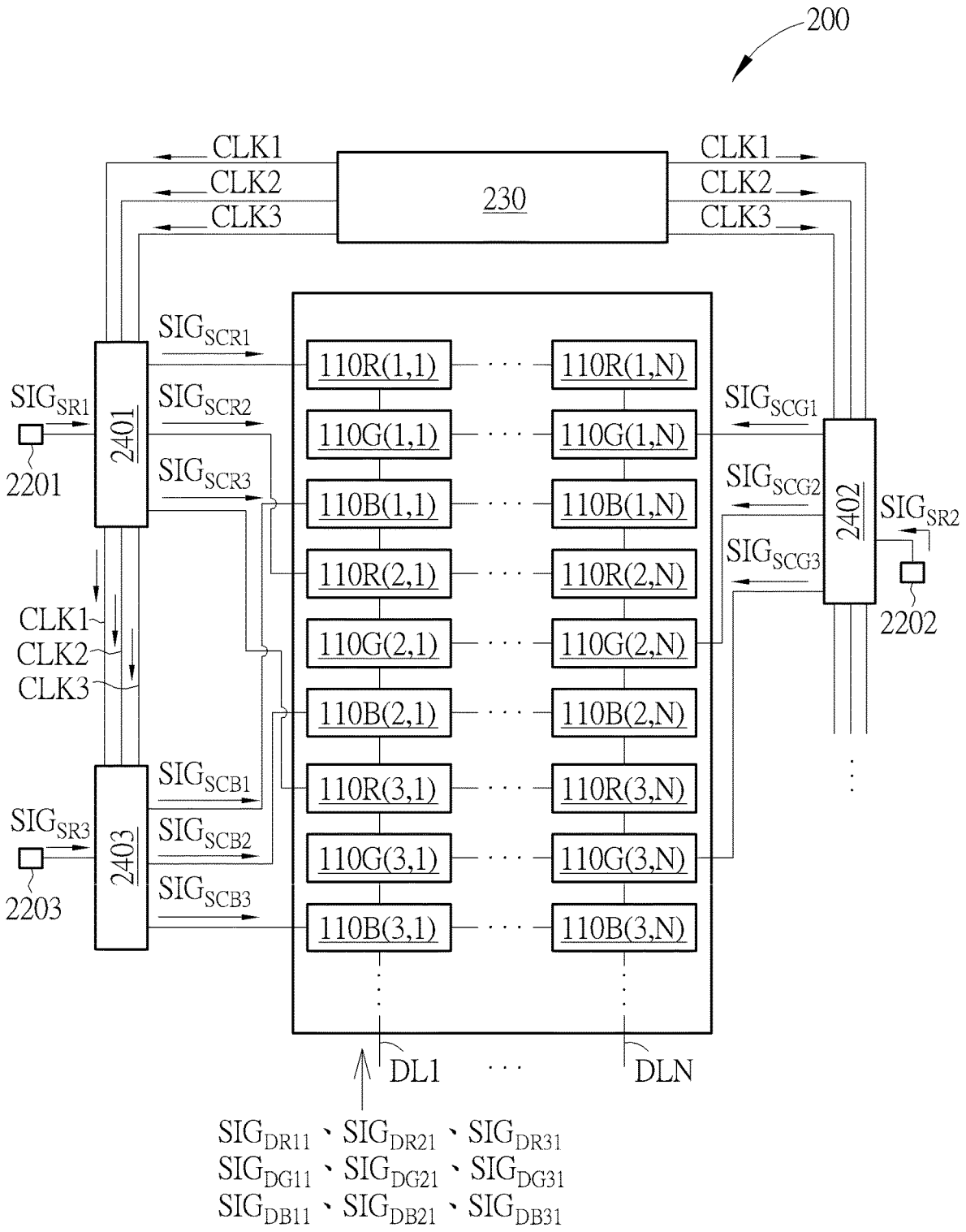
FIG. 2 shows a schematic diagram of an electronic device according to another embodiment of the present disclosure.

FIG. 2 shows a schematic diagram of an electronic device 200 according to another embodiment of the present disclosure. The electronic device 200 and the electronic device 100 have similar structures and can be operated with similar principles. However, the electronic device 200 can further include shift registers 2201, 2202, and 2203, a driver circuit 230, and demultiplexers 2401, 2402, and 2403. The shift register 2201 can output a first shift signal $SIG_{SR1}$, the shift register 2202 can output a second shift signal $SIG_{SR2}$, and the shift register 2203 can output a third shift signal $SIG_{SR3}$. The driver circuit 230 can output clock signals CLK1, CLK2, and CLK3.

In addition, the demultiplexer 2401 can be coupled to the shift register 2201 and the driver circuit 230. The demultiplexer 2401 can receive the first shift signal $SIG_{SR1}$ and output first scan signals $SIG_{SCR1}$, $SIG_{SCR2}$, and $SIG_{SCR3}$ according to the clock signals CLK1, CLK2, and CLK3. Meanwhile, the data line DL1 can transmit corresponding data signals $SIG_{DR11}$, $SIG_{DR21}$, and $SIG_{DR31}$. That is, the first sub pixels 110R(1,1), 110R(2,1), and 110R(3,1) can receive data signals $SIG_{DR11}$, $SIG_{DR21}$, and $SIG_{DR31}$ successively according to the first scan signals $SIG_{SCR1}$, $SIG_{SCR2}$, and $SIG_{SCR3}$.

Similarly, the demultiplexer 2402 can be coupled to the shift register 2202 and the driver circuit 230. The demultiplexer 2402 can receive the second shift signal $SIG_{SR2}$ and output second scan signals $SIG_{SCG1}$, $SIG_{SCG2}$, and $SIG_{SCG3}$ according to the clock signals CLK1, CLK2, and CLK3. Meanwhile, the data line DL1 can transmit corresponding data signals $SIG_{DG11}$, $SIG_{DG21}$, and $SIG_{DG31}$.

Similarly, the demultiplexer 2403 can be coupled to the shift register 2203 and the driver circuit 230. The demultiplexer 2403 can receive the third shift signal $SIG_{SR3}$ and output third scan signals $SIG_{SCB1}$, $SIG_{SCB2}$, and $SIG_{SCB3}$ according to the clock signals CLK1, CLK2, and CLK3. Meanwhile, the data line DL1 can transmit corresponding data signals $SIG_{DB11}$, $SIG_{DB21}$, and $SIG_{DB31}$.

Figure 3:
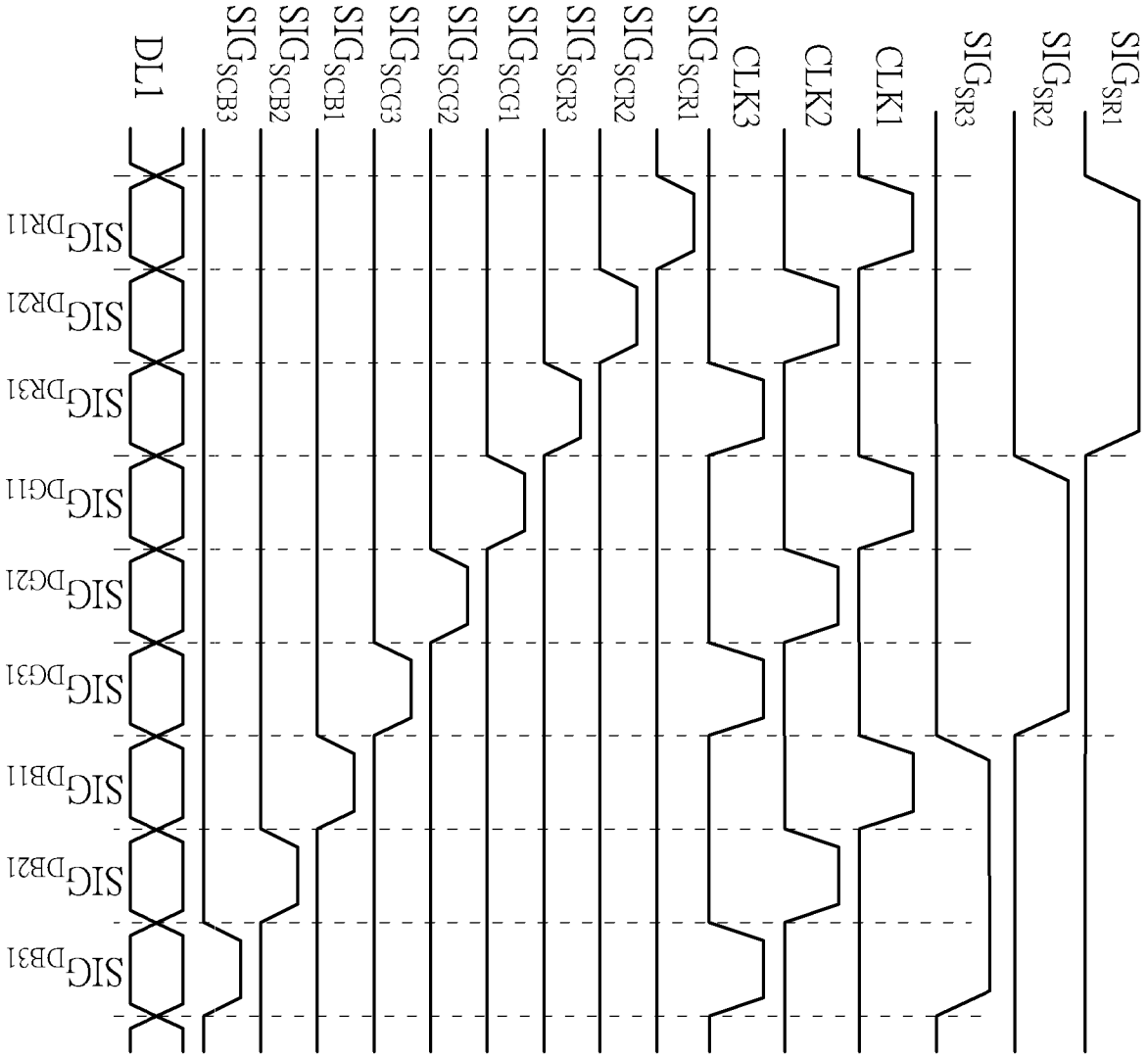
FIG. 3 shows a signal timing diagram of the electronic device in FIG. 2 according to one embodiment of the present disclosure.

FIG. 3 shows a signal timing diagram of the electronic device 200 according to one embodiment of the present disclosure. In FIG. 3, the first shift signal $SIG_{SR1}$, the second shift signal $SIG_{SR2}$, and the third shift signal $SIG_{SR3}$ can be raised to the high voltage sequentially, and are at the high voltage at different periods of time. In addition, the clock signals CLK1, CLK2, and CLK3 can be raised to the high voltage sequentially when the shift signals $SIG_{SR1}$, $SIG_{SR2}$, and $SIG_{SR3}$ are at the high voltage. Also, the clock signals CLK1, CLK2, and CLK3 are at the high voltage at different periods of time. In FIG. 3, it should be noted that although the signals are raised to the high voltage sequentially, the order for raising the voltages of the signals can be changed. For example, the first shift signal $SIG_{SR1}$, the third shift signal $SIG_{SR3}$, and the second shift signal $SIG_{SR2}$ can be raised to the high voltage sequentially, but the present disclosure is not limited thereto.

In this case, since the data line DL1 will transmit three data signals of the same color successively, and transmit three data signals of another color later, the amount of the voltage change and/or the frequency of the voltage change on the data line DL1 can be reduced, thereby reducing the power consumption.

Figure 4:
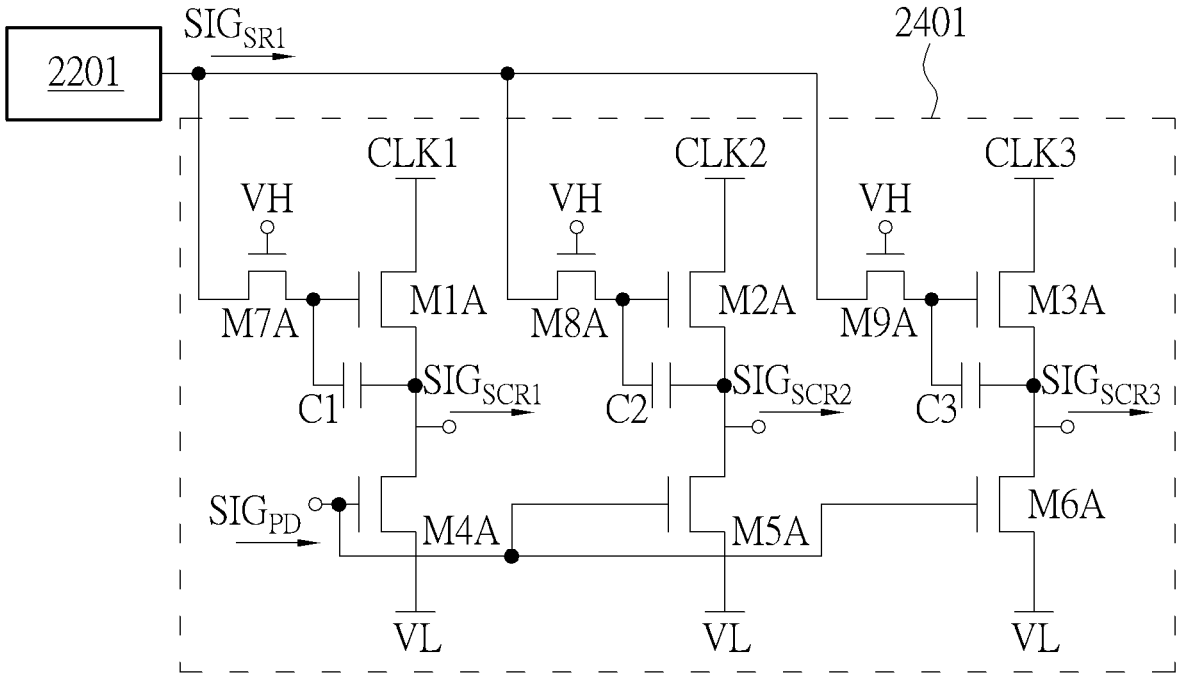
FIG. 4 shows a schematic diagram of the demultiplexer in FIG. 2 according to one embodiment of the present disclosure.

Furthermore, in some embodiments, when the electronic device 100 receives the image data, the data signals are usually transmitted for the pixels row by row. Therefore, to transmit more data signals of the same color on the data line DL1 successively, the electronic device 100 may require more temporary storage space to store multiple rows of image data, and the data signals will be transmitted to the corresponding sub pixels through the data line DL1 when the multiple rows of image data are received. That is, the number of the clock signals and the number of the successively—transmitted data signals of the same color may be increased or reduced according to the actual demand. FIG. 4 shows a schematic diagram of the demultiplexer 2401 according to one embodiment of the present disclosure. The demultiplexer 2401 can include transistors M1A, M2A, and M3A. Each of the transistors M1A, M2A, and M3A has a first terminal, a second terminal, and a control terminal. The first terminals of the transistors M1A, M2A, and M3A can receive the clock signals CLK1, CLK2, and CLK3 respectively, the second terminals of the transistors M1A, M2A, and M3A can output the first scan signals $SIG_{SCR1}$, $SIG_{SCR2}$, and $SIG_{SCR3}$ respectively, and the control terminals of the transistors M1A, M2A, and M3A can be coupled to the shift register 2201.

In FIG. 4, the demultiplexer 2401 can further include transistors M4A, M5A, and M6A. Each of the transistors M4A, M5A, and M6A has a first terminal, a second terminal, and a control terminal respectively. The first terminals of the transistors M4A, M5A, and M6A can be coupled to the second terminals of the transistors M1A, M2A, and M3A respectively, the second terminals of the transistors M4A, M5A, and M6A can receive the first voltage VL respectively, and the control terminals of the transistors M4A, M5A, and M6A can receive the pull down control signal $SIG_{PD}$ respectively. In some embodiments, the pull down control signal $SIG_{PD}$ can be generated by the electronic device 100 internally or by an external control circuit. During the non-scanning period, the pull down control signal $SIG_{PD}$ can turn on the transistors M4A, M5A, and M6A so the first scan signals $SIG_{SCR1}$, $SIG_{SCR2}$, and $SIGS_{CR3}$ can be pulled down to the first voltage VL, reducing the possibility that the sub pixels are driven unexpectedly.

Furthermore, since the transistors M1A to M3A can be N-type transistors, the first scan signals $SIG_{SCR1}$, $SIG_{SCR2}$, $SIG_{SCR3}$ transmitted by the transistors M1A to M3A may be limited by the threshold voltages of the transistors M1A to M3A. In this case, to ensure that the first scan signals $SIG_{SCR1}$, $SIG_{SCR2}$, $SIG_{SCR3}$ can reach the high voltage level of the clock signals CLK1, CLK2, and CLK3, the demultiplexer 2401 can further include the transistors M7A, M8A, and M9A.

In FIG. 4, control terminals of the transistors M1A, M2A, and M3A can be coupled to the shift register 2201 through the transistors M7A, M8A, and M9A respectively, and the control terminals of the transistors M7A, M8A, and M9A can receive the second voltage VH. In some embodiments, the second voltage VH can be the operation voltage of the electronic device 100, and can be higher than the first voltage VL. Therefore, the transistors M7A, M8A, and M9A can keep a turn-on state. The capacitors C1, C2, and C3 can be coupled between the control terminals and the second terminals of the transistors M1A, M2A, and M3A respectively. The transistors M7A, M8A, and M9A and the capacitors C1, C2, and C3 can be used to raise the voltages received by the control terminals of the transistors M1A, M2A, and M3A respectively, and the first scan signals $SIG_{SCR1}$, $SIG_{SCR2}$, $SIG_{SCR3}$ can reach the high voltage level of the clock signals CLK1, CLK2, and CLK3.

In FIG. 4, the transistors M1A to M9A can all be N-type transistors, so the manufacturing process is simpler. However, in some other embodiments of the present disclosure, the demultiplexer 2401 can also be implemented with P-type transistors only, or with P-type transistors and N-type transistors. In addition, although FIG. 4 shows an example of the structure of the demultiplexer 2401, in some other embodiments, the demultiplexers 2401 to 2403 can be implemented with some other structures and can still be operated with the timing diagram shown in FIG. 3.

Figure 5:
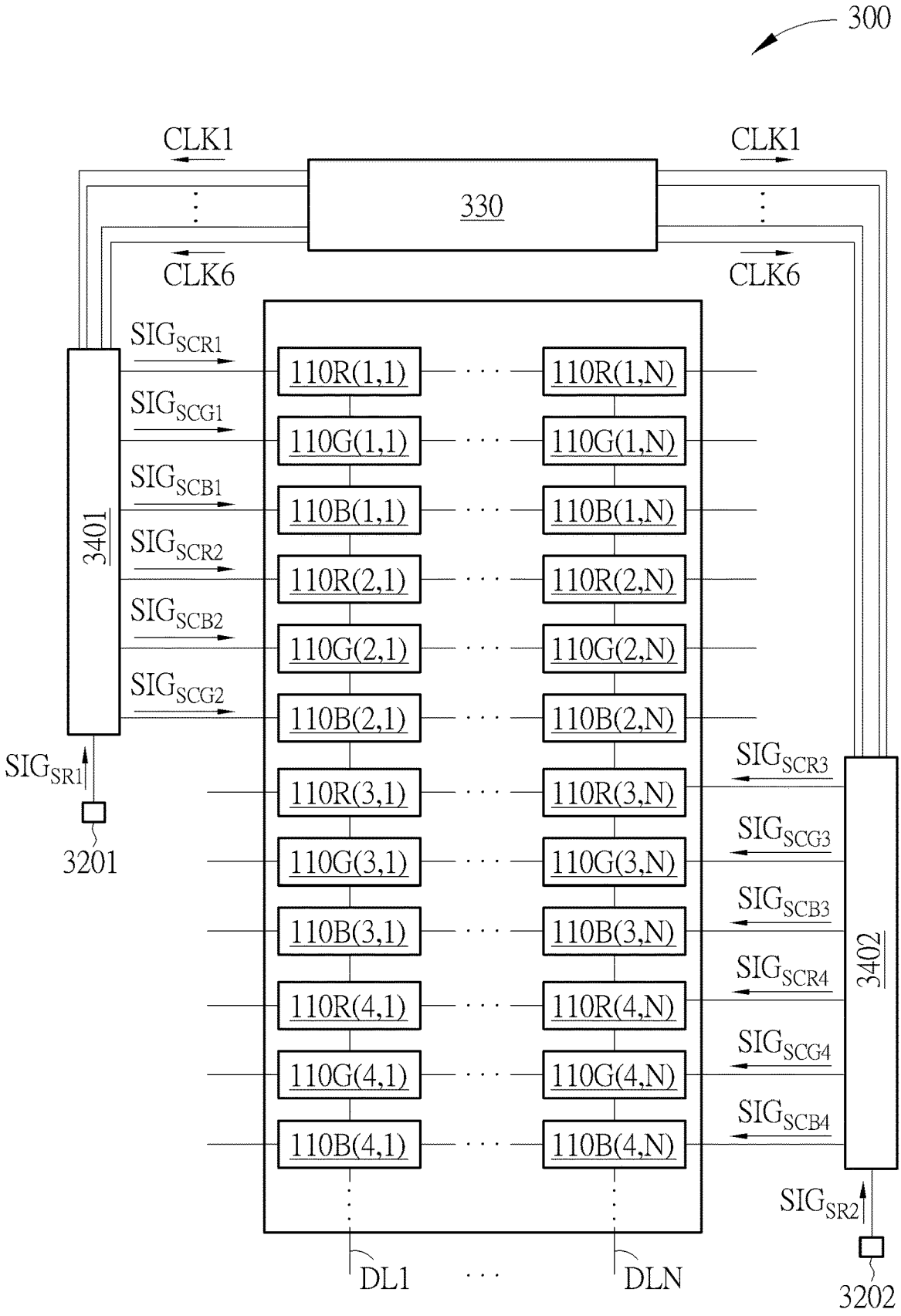
FIG. 5 shows a schematic diagram of an electronic device according to another embodiment of the present disclosure.

FIG. 5 shows a schematic diagram of an electronic device 300 according to another embodiment of the present disclosure. The electronic device 300 and the electronic device 100 have similar structures can be operated with similar principles. However, the electronic device 300 can further include shift registers 3201 and 3202, a driver circuit 330, and demultiplexers 3401 and 3402. The shift register 3201 can output a first shift signal $SIG_{SR1}$, and the shift register 3202 can output a second shift signal $SIG_{SR2}$. The driver circuit 330 can output clock signals CLK1, CLK2, CLK3, CLK4, CLK5, and CLK6.

In addition, the demultiplexer 3401 can be coupled to the shift register 3201 and the driver circuit 330. The demultiplexer 3401 can receive the first shift signal $SIG_{SR1}$ and output first scan signals $SIG_{SCR1}$, $SIG_{SCR2}$, second scan signals $SIG_{SCG1}$, $SIG_{SCG2}$, and third scan signals $SIG_{SCR1}$, $SIG_{SCR2}$ according to the clock signals CLK1, CLK2, CLK3, CLK4, CLK5, and CLK6. The demultiplexer 3402 can be coupled to the shift register 3202 and the driver circuit 330. The demultiplexer 3402 can receive the second shift signal $SIG_{SR2}$ and output first scan signals $SIG_{SCR3}$, $SIG_{SCR4}$, second scan signals $SIG_{SCG3}$, $SIG_{SCG4}$, and third scan signals $SIG_{SCR3}$, $SIG_{SCR4}$ according to the clock signals CLK1, CLK2, CLK3, CLK4, CLK5, and CLK6.

Figure 6:
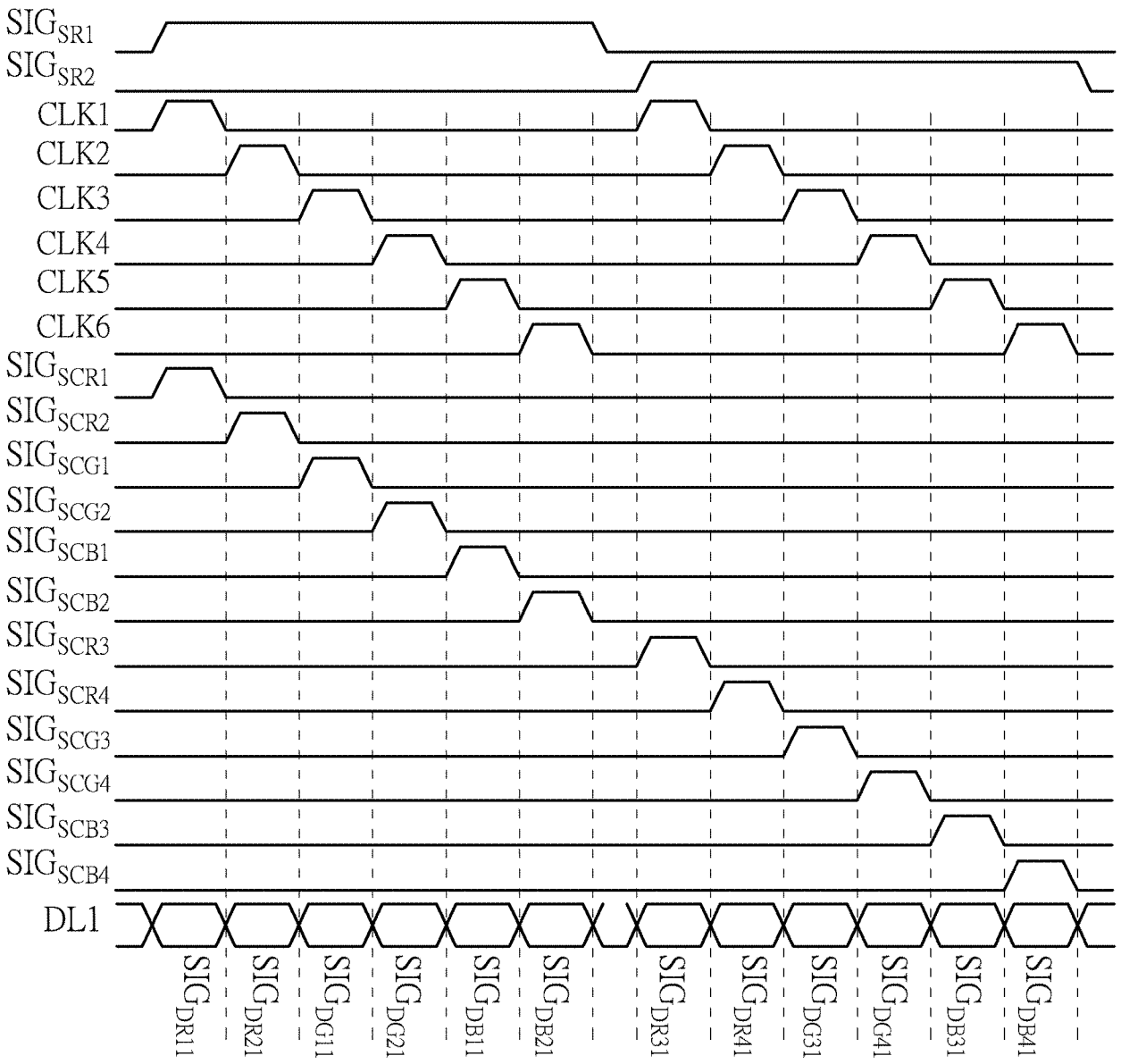
FIG. 6 shows a signal timing diagram of the electronic device in FIG. 5 according to one embodiment of the present disclosure.

FIG. 6 shows a signal timing diagram of the electronic device 300 according to one embodiment of the present disclosure. In FIG. 6, the shift signal $SIG_{SR1}$ and the second shift signal $SIG_{SR2}$ can be raised to the high voltage sequentially, and are at the high voltage at different periods of time. In addition, the clock signals CLK1, CLK2, CLK3, CLK4, CLK5, and CLK6 can be raised to the high voltage sequentially when the shift signals $SIG_{SR1}$ and $SIG_{SR2}$ are at the high voltage. Also, the clock signals CLK1, CLK2, CLK3, CLK4, CLK5, and CLK6 are at the high voltage at different periods of time. However, the order for raising the voltages of the signals is not limited by FIG. 6.

In this case, when the first shift signal $SIG_{SR1}$ is at the high voltage, the demultiplexer 3401 can respectively output the first scan signals $SIG_{SCR1}$ and $SIG_{SCR2}$ to the first sub pixels 110R(1,1) and 110R(2,1) according to the clock signals CLK1 and CLK2, output the second scan signals $SIG_{SCG1}$ and $SIG_{SCG2}$ to the second sub pixels 110G(1,1) and 110G(2,1) according to the clock signals CLK3 and CLK4, and output the third scan signals $SIG_{SCB1}$ and $SIG_{SCB2}$ to the third sub pixels 110B(1,1) and 110B(2,1) according to the clock signals CLK5 and CLK6. Meanwhile, the data line DL1 would correspondingly transmit the data signals $SIG_{DR11}$, $SIG_{DR21}$, $SIG_{DG11}$, $SIG_{DG21}$, $SIG_{DB11}$, and $SIG_{DB21}$.

Similarly, when the second shift signal $SIG_{SR2}$ is at the high voltage, the demultiplexer 3402 can respectively output the first scan signals $SIG_{SCR3}$ and $SIG_{SCR4}$ to the first sub pixels 110R(3,1) and 110R(4,1) according to the clock signals CLK1 and CLK2, output the second scan signals $SIG_{SCG3}$ and $SIG_{SCG4}$ to the second sub pixels 110G(3,1) and 110G(4,1) according to the clock signals CLK3 and CLK4, and output the third scan signals $SIG_{SCB3}$ and $SIG_{SCB4}$ to the third sub pixels 110B(3,1) and 110B(4,1) according to the clock signals CLK5 and CLK6. Meanwhile, the data line DL1 would correspondingly transmit the data signals $SIG_{DR31}$, $SIG_{DR41}$, $SIG_{DG31}$, $SIG_{DG41}$, $SIG_{DB31}$, and $SIG_{DB41}$.

That is, in the electronic device 300, the demultiplexers 3401 and 3402 will output scan signals to sub pixels of different colors, and the data line DL1 can transmit two data signals corresponding to the same color successively, so the amount of the voltage change and the frequency of the voltage change on the data line DL1 can be reduced, thereby reducing the power consumption.

Figure 7:
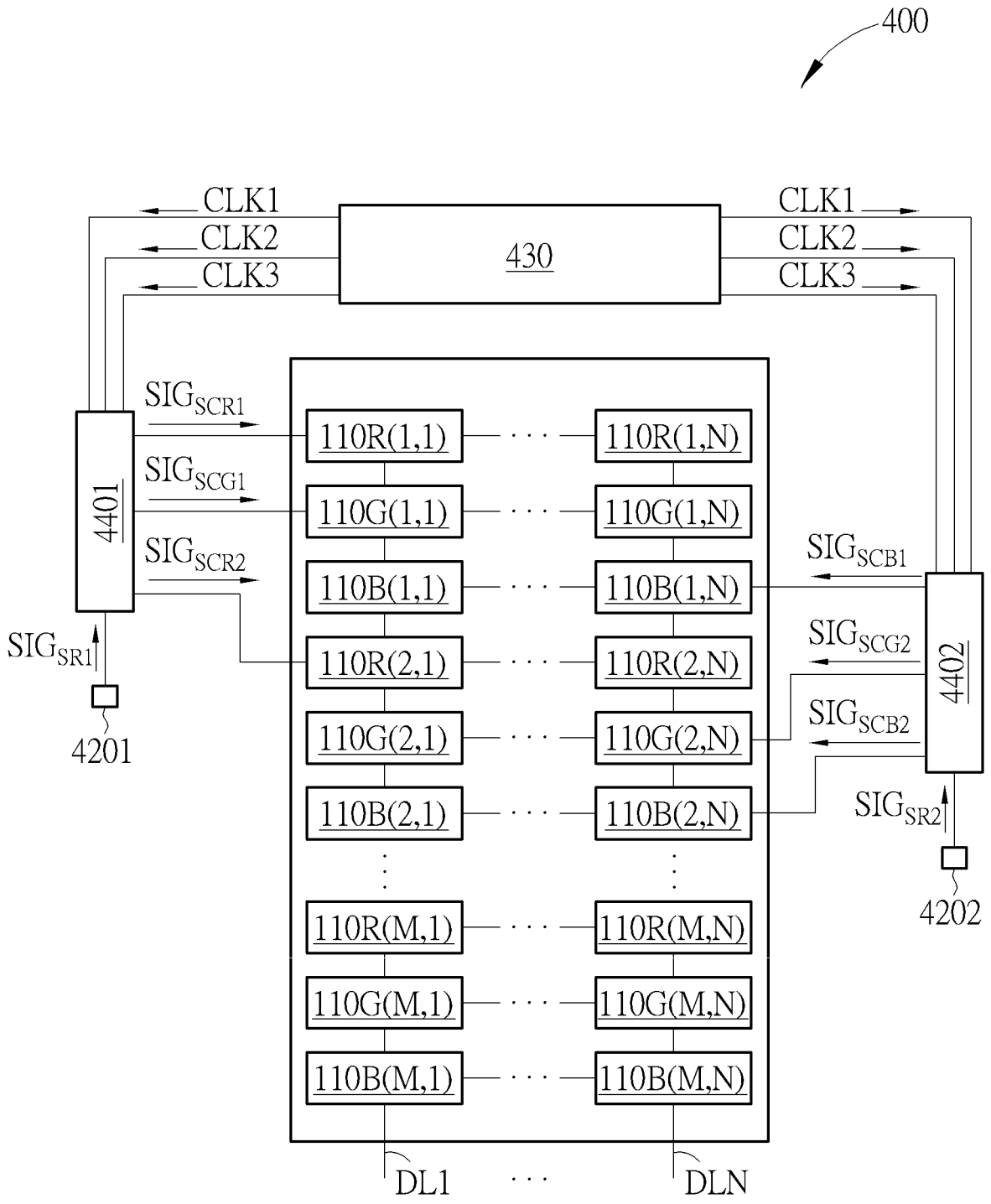
FIG. 7 shows a schematic diagram of an electronic device according to another embodiment of the present disclosure.

FIG. 7 shows a schematic diagram of an electronic device 400 according to another embodiment of the present disclosure. The electronic device 400 and the electronic device 100 have similar structures and can be operated with similar principles. However, the electronic device 400 can further include shift registers 4201 and 4202, a driver circuit 430, and demultiplexers 4401 and 4402. The shift register 4201 can output a first shift signal $SIG_{SR1}$, and the shift register 4202 can output a second shift signal $SIG_{SR2}$. The driver circuit 430 can output clock signals CLK1, CLK2, and CLK3.

In addition, the demultiplexer 4401 can be coupled to the shift register 4201 and the driver circuit 430. The demultiplexer 4401 can receive the first shift signal $SIG_{SR1}$ and output first scan signals $SIG_{SCR1}$, $SIG_{SCR2}$, and a second scan signal $SIG_{SCG1}$ according to the clock signals CLK1, CLK2, and CLK3. The demultiplexer 4402 can be coupled to the shift register 4202 and the driver circuit 430. The demultiplexer 4402 can receive the second shift signal $SIG_{SR2}$ and output a second scan signal $SIG_{SCG2}$ and third scan signal $SIG_{SCB1}$, and $SIG_{SCB2}$ according to the clock signals CLK1, CLK2, and CLK3.

Figure 8:
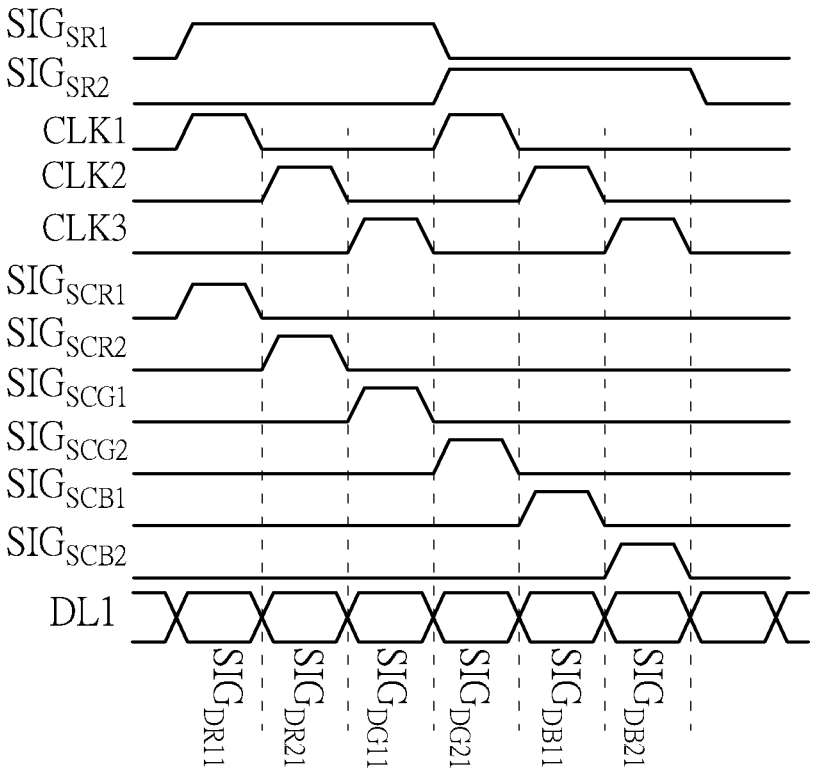
FIG. 8 shows a signal timing diagram of the electronic device in FIG. 7 according to one embodiment of the present disclosure.

FIG. 8 shows a signal timing diagram of the electronic device 400 according to one embodiment of the present disclosure. In FIG. 8, the shift signal $SIG_{SR1}$ and the second shift signal $SIG_{SR2}$ can be raised to the high voltage sequentially, and are at the high voltage at different periods of time. In addition, the clock signals CLK1, CLK2, and CLK3 can be raised to the high voltage sequentially when the shift signals $SIG_{SR1}$ and $SIG_{SR2}$ are at the high voltage. Also, the clock signals CLK1, CLK2, and CLK3 are at the high voltage at different periods of time. However, the order for raising the voltages of the signals is not limited by FIG. 8.

In this case, when the first shift signal $SIG_{SR1}$ is at the high voltage, the demultiplexer 4401 can output the first scan signals $SIG_{SCR1}$ and $SIG_{SCR2}$ to the first sub pixel 110R(1,1) and 110R(2,1) according to the clock signals CLK1 and CLK2 respectively, and output the second scan signal $SIG_{SCG1}$ to the second sub pixel 110G(1,1) according to the clock signal CLK3. Meanwhile, the data line DL1 would correspondingly transmit the data signals $SIG_{DR11}$, $SIG_{DR21}$, and $SIG_{DG11}$.

Similarly, when the second shift signal $SIG_{SR2}$ is at the high voltage, the demultiplexer 4402 can output the second scan signal $SIG_{SCG2}$ to the second sub pixel 110G(2,1) according to the clock signal CLK1 and output the third scan signals $SIG_{SCB1}$ and $SIG_{SCB2}$ to the third sub pixels 110B (1,1) and 110B(2,1) according to the clock signals CLK2 and CLK3 respectively. Meanwhile, the data line DL1 would correspondingly transmit the data signals $SIG_{DG21}$, $SIG_{DB11}$, and $SIG_{DB21}$.

That is, with the demultiplexers 4401 and 4402, the electronic device 400 can output the two scan signals to the sub pixels of the same color successively, and the data line DL1 can transmit two data signals corresponding to the same color successively, so the power consumption caused by frequent voltage change of the data lines can be reduced.

Figure 9:
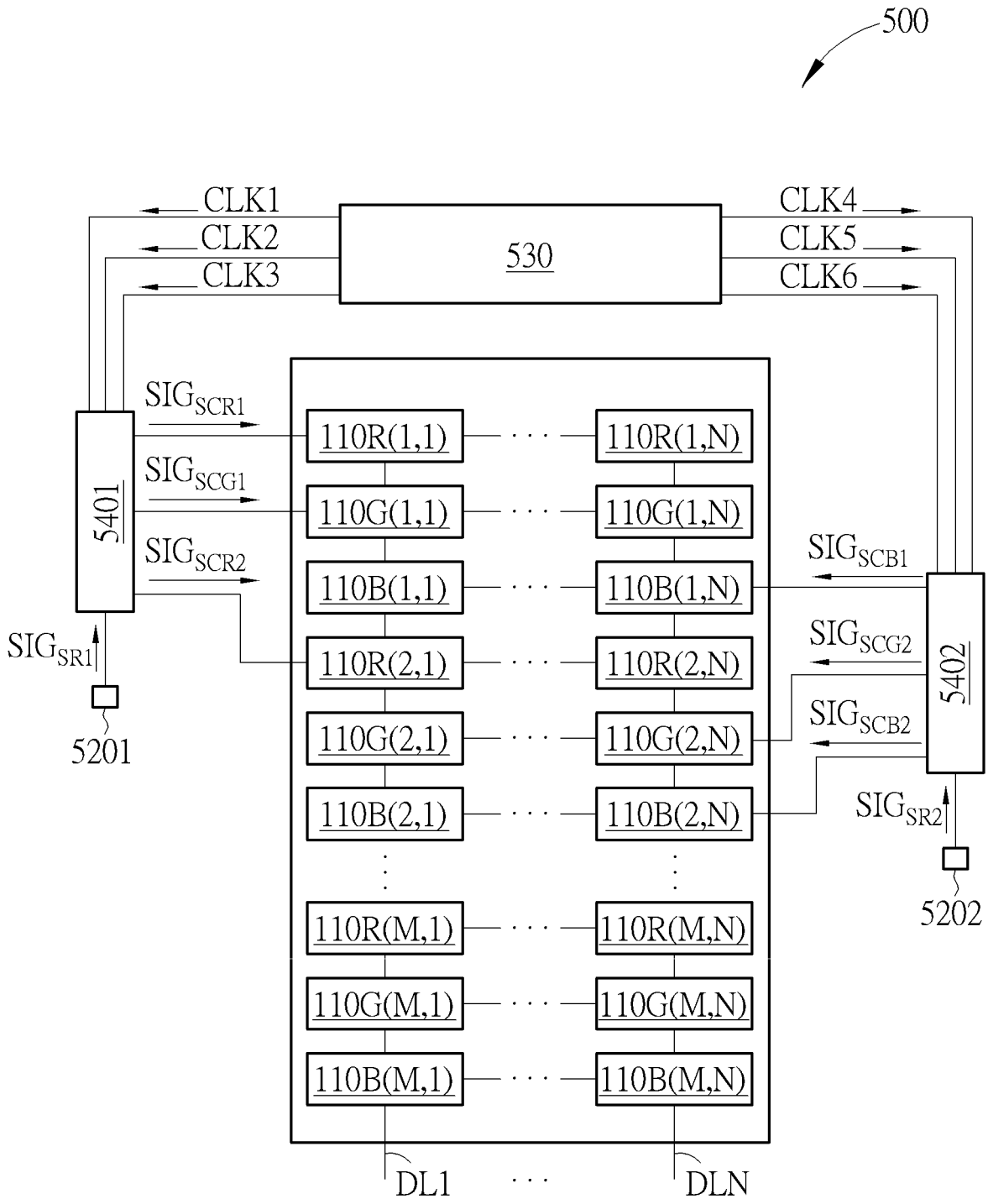
FIG. 9 shows a schematic diagram of an electronic device according to another embodiment of the present disclosure.

FIG. 9 shows a schematic diagram of an electronic device 500 according to another embodiment of the present disclosure. The electronic device 500 and the electronic device 100 have similar structures and can be operated with similar principles. However, the electronic device 500 can further include shift registers 5201 and 5202, a driver circuit 530, and demultiplexers 5401 and 5402. The shift register 5201 can output a first shift signal $SIG_{SR1}$, and the shift register 5202 can output a second shift signal $SIG_{SR2}$. The driver circuit 530 can output clock signals CLK1, CLK2, CLK3, CLK4, CLK5, and CLK6.

In addition, the demultiplexer 5401 can be coupled to the shift register 5201 and the driver circuit 530. The demultiplexer 5401 can receive the first shift signal $SIG_{SR1}$ and output first scan signals $SIG_{SCR1}$, $SIG_{SCR2}$, and a second scan signal $SIG_{SCG1}$ according to the clock signals CLK1, CLK2, and CLK3 respectively. The demultiplexer 5402 can be coupled to the shift register 5202 and the driver circuit 530. The demultiplexer 5402 can receive the second shift signal $SIG_{SR2}$ and output a second scan signal $SIG_{SCG2}$ and third scan signals $SIG_{SCB1}$ and $SIG_{SCB2}$ according to the clock signals CLK4, CLK5, and CLK6 respectively.

Figure 10:
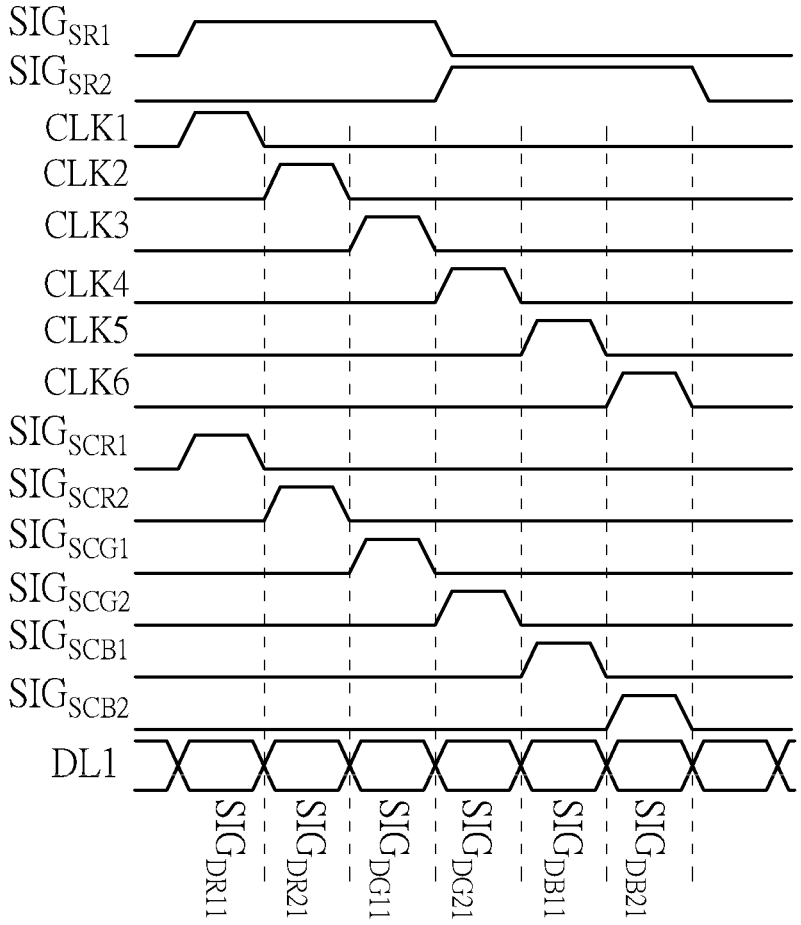
FIG. 10 shows a signal timing diagram of the electronic device in FIG. 9 according to one embodiment of the present disclosure.

FIG. 10 shows a signal timing diagram of the electronic device 500 according to one embodiment of the present disclosure. In FIG. 10, the shift signal $SIG_{SR1}$ and the second shift signal $SIG_{SR2}$ can be raised to the high voltage sequentially, and are at the high voltage at different periods of time. In addition, the clock signals CLK1, CLK2, and CLK3 can be raised to the high voltage sequentially when the shift signal $SIG_{SR1}$ is at the high voltage. Also, the clock signals CLK1, CLK2, and CLK3 are at the high voltage at different periods of time. The clock signals CLK4, CLK5, and CLK6 can be raised to the high voltage sequentially when the shift signal $SIG_{SR2}$ is at the high voltage. Also, the clock signals CLK4, CLK5, and CLK6 are at the high voltage at different periods of time. However, the order for raising the voltages of the signals is not limited by FIG. 10.

In this case, when the first shift signal $SIG_{SR1}$ is at the high voltage, the demultiplexer 5401 can output the first scan signals $SIG_{SCR1}$ and $SIG_{SCR2}$ to the first sub pixels 110R(1, 1) and 110R(2,1) according to the clock signals CLK1 and CLK2 respectively, and output the second scan signal $SIG_{SCG1}$ to the second sub pixel 110G(1,1) according to the clock signal CLK3. Meanwhile, the data line DL1 would correspondingly transmit the data signals $SIG_{DR11}$, $SIG_{DR21}$, and $SIG_{DG11}$.

Similarly, when the second shift signal $SIG_{SR2}$ is at the high voltage, the demultiplexer 5402 can output the second scan signal $SIG_{SCG1}$ to the second sub pixel 110G(2,1) according to the clock signal CLK4 and output the third scan signals $SIG_{SCB1}$ and $SIG_{SCB2}$ to the third sub pixels 110B (1,1) and 110B(2,1) according to the clock signals CLK5 and CLK6 respectively. Meanwhile, the data line DL1 would correspondingly transmit the data signals $SIG_{DG21}$, $SIG_{DB11}$, and $SIG_{DB21}$.

That is, with the demultiplexers 5401 and 5402, the electronic device 500 can output the two scan signals to the sub pixels of the same color successively, and the data line DL1 can transmit two data signals corresponding to the same color successively, so the power consumption caused by frequent voltage change of the data lines can be reduced. In addition, the designer can also choose the driver circuit 530 properly to generate the desired clock signals according to the system requirement.

Figure 11:
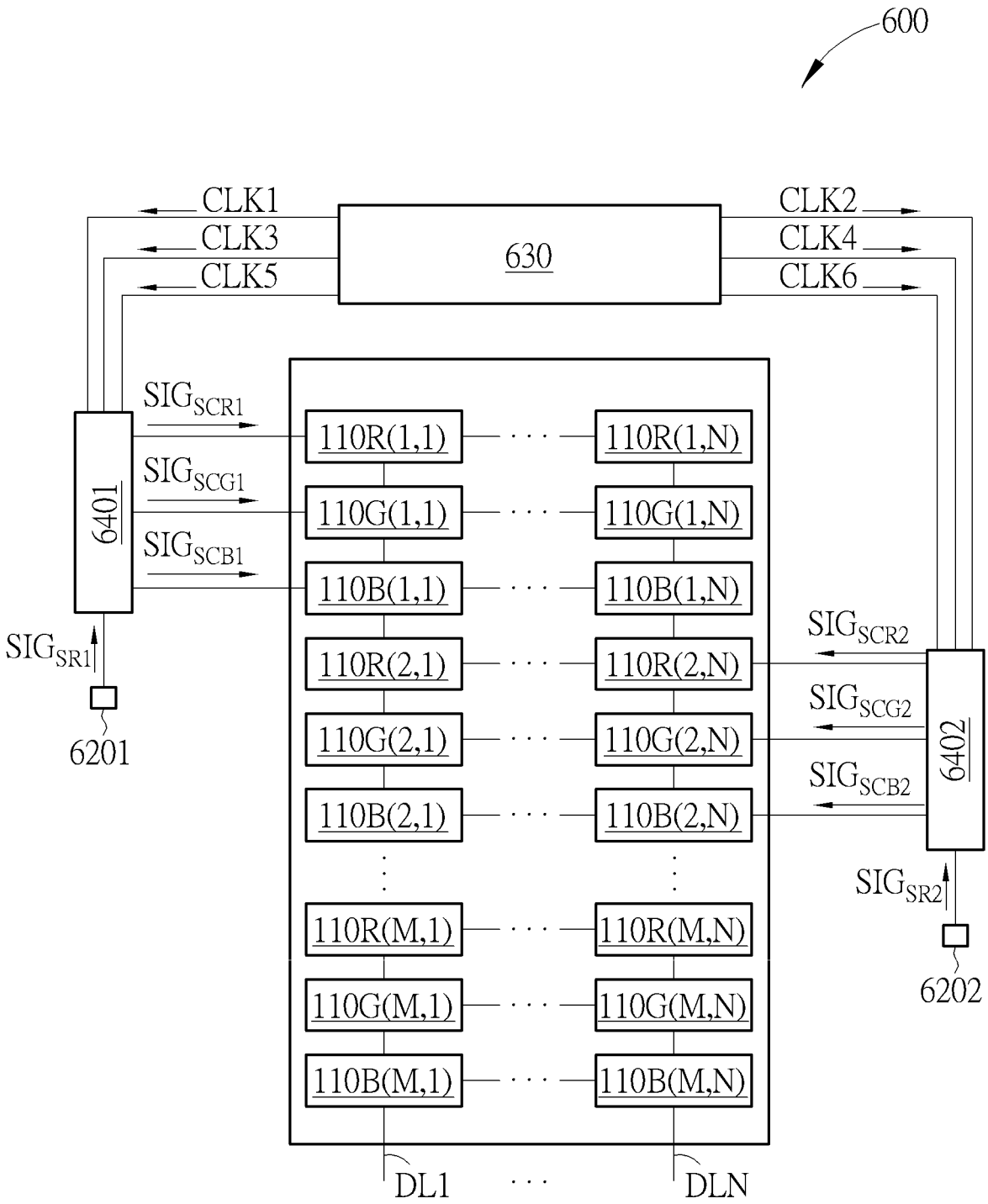
FIG. 11 shows a schematic diagram of an electronic device according to another embodiment of the present disclosure.

FIG. 11 shows a schematic diagram of an electronic device 600 according to another embodiment of the present disclosure. The electronic device 600 and the electronic device 100 have similar structures and can be operated with similar principles. However, the electronic device 600 can further include shift registers 6201 and 6202, a driver circuit 630, and demultiplexers 6401 and 6402. The shift register 6201 can output a first shift signal $SIG_{SR1}$, and the shift register 6202 can output a second shift signal $SIG_{SR2}$. The driver circuit 630 can output clock signals CLK1, CLK2, CLK3, CLK4, CLK5, and CLK6.

In addition, the demultiplexer 6401 can be coupled to the shift register 6201 and the driver circuit 630. The demultiplexer 6401 can receive the first shift signal $SIG_{SR1}$ and output a first scan signal $SIG_{SCR1}$, a second scan signal $SIG_{SCG1}$, and a third scan signal $SIG_{SCB1}$ according to the clock signals CLK1, CLK3, and CLK5 respectively. The demultiplexer 6402 can be coupled to the shift register 6202 and the driver circuit 630. The demultiplexer 6402 can receive the second shift signal $SIG_{SR2}$ and output a first scan signal $SIG_{SCR2}$, a second scan signal $SIG_{SCG2}$, and a third scan signal $SIG_{SCB2}$ according to the clock signals CLK2, CLK4, and CLK6 respectively.

Figure 12:
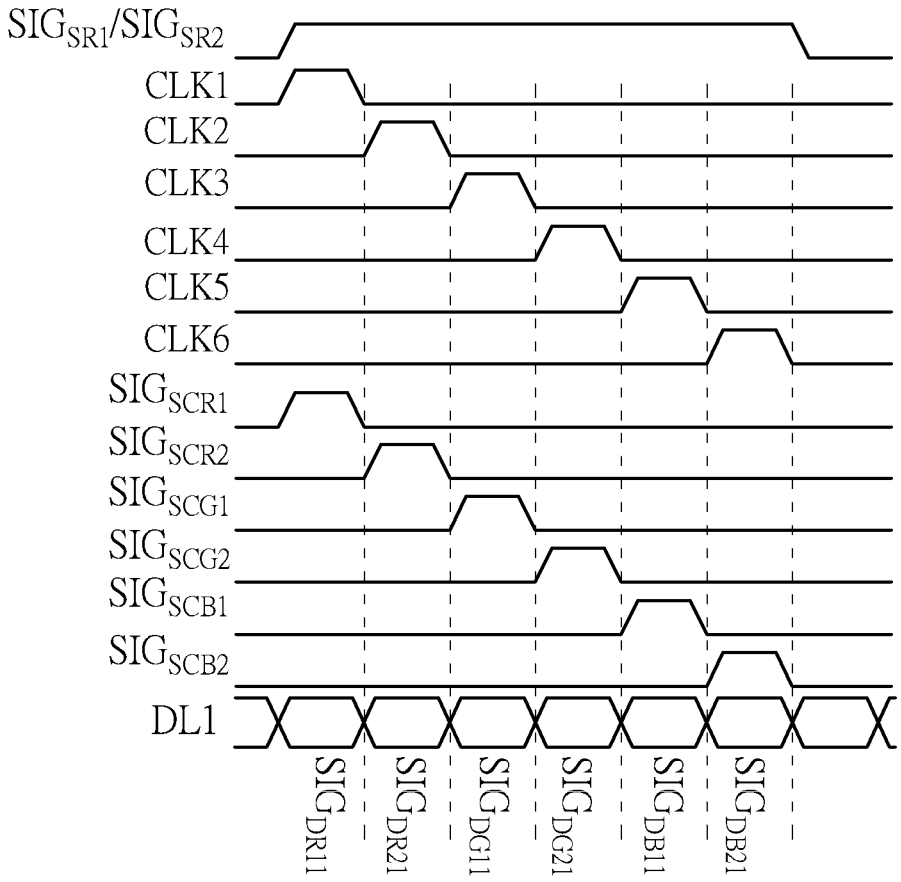
FIG. 12 shows a signal timing diagram of the electronic device in FIG. 11 according to one embodiment of the present disclosure.

FIG. 12 shows a signal timing diagram of the electronic device 600 according to one embodiment of the present disclosure. In FIG. 12, the first shift signal $SIG_{SR1}$ and the second shift signal $SIG_{SR2}$ can have the same and synchronized waveforms. Also, the clock signals CLK1, CLK2, CLK3, CLK4, CLK5, and CLK6 can be raised to the high voltage sequentially when the shift signals $SIG_{SR1}$ and $SIG_{SR2}$ are at the high voltage. Also, the clock signals CLK1, CLK2, CLK3, CLK4, CLK5, and CLK6 are at the high voltage at different periods of time. However, the order for raising the voltages of the signals is not limited by FIG. 12.

In this case, when the first shift signal $SIG_{SR1}$ is at the high voltage, the demultiplexer 6401 can output the first scan signal $SIG_{SCR1}$ according to the clock signal CLK1, and then, the demultiplexer 6402 can output the first scan signal $SIG_{SCR2}$ according to the clock signal CLK2. Later, the demultiplexer 6401 can output the second scan signal $SIG_{SCG1}$ according to the clock signal CLK3, and the demultiplexer 6402 can output the second scan signal $SIG_{SCG2}$ according to the clock signal CLK4. Then, the demultiplexer 6401 can output the third scan signal $SIG_{SCB1}$ according to the clock signal CLK5, and the demultiplexer 6402 can output the third scan signal $SIG_{SCB2}$ according to the clock signal CLK6. Meanwhile, the data line DL1 would correspondingly transmit the data signals $SIG_{DR11}$, $SIG_{DR21}$, $SIG_{DG11}$, $SIG_{DG21}$, $SIG_{DB11}$, and $SIG_{DB21}$.

That is, with the demultiplexers 6401 and 6402, the electronic device 600 can output the two scan signals to the sub pixels of the same color successively, and the data line DL1 can transmit two data signals corresponding to the same color successively, so the power consumption caused by frequent voltage change of the data lines can be reduced. In addition, in the electronic device 600, the shift register 6201 and the demultiplexer 6401 can be disposed at the first side (for example but not limited to the left side) of the data lines DL1 to DLN, and the shift register 6202 and the demultiplexer 6402 can be disposed at the second side (for example but not limited to the right side) of the data lines DL1 to DLN. In this case, the first sub pixels 110R(1,1) to 110R(1,N) can be controlled by the first scan signal $SIG_{SCR1}$ outputted by the demultiplexer 6401 while the first sub pixels 110R(2,1) to 110R(2,N) can be controlled by the first scan signal $SIG_{SCR2}$ outputted by the demultiplexer 6402. Therefore, each two adjacent rows of first sub pixels, such as the first sub pixels 110R(1,1) to 110R(1,N) and the first sub pixels 110R(2,1) to 110R(2,N) can receive the first scan signals $SIG_{SCR1}$ and $SIG_{SCR2}$ from different sides, and the uniformity of brightness can be improved.

Figure 13:
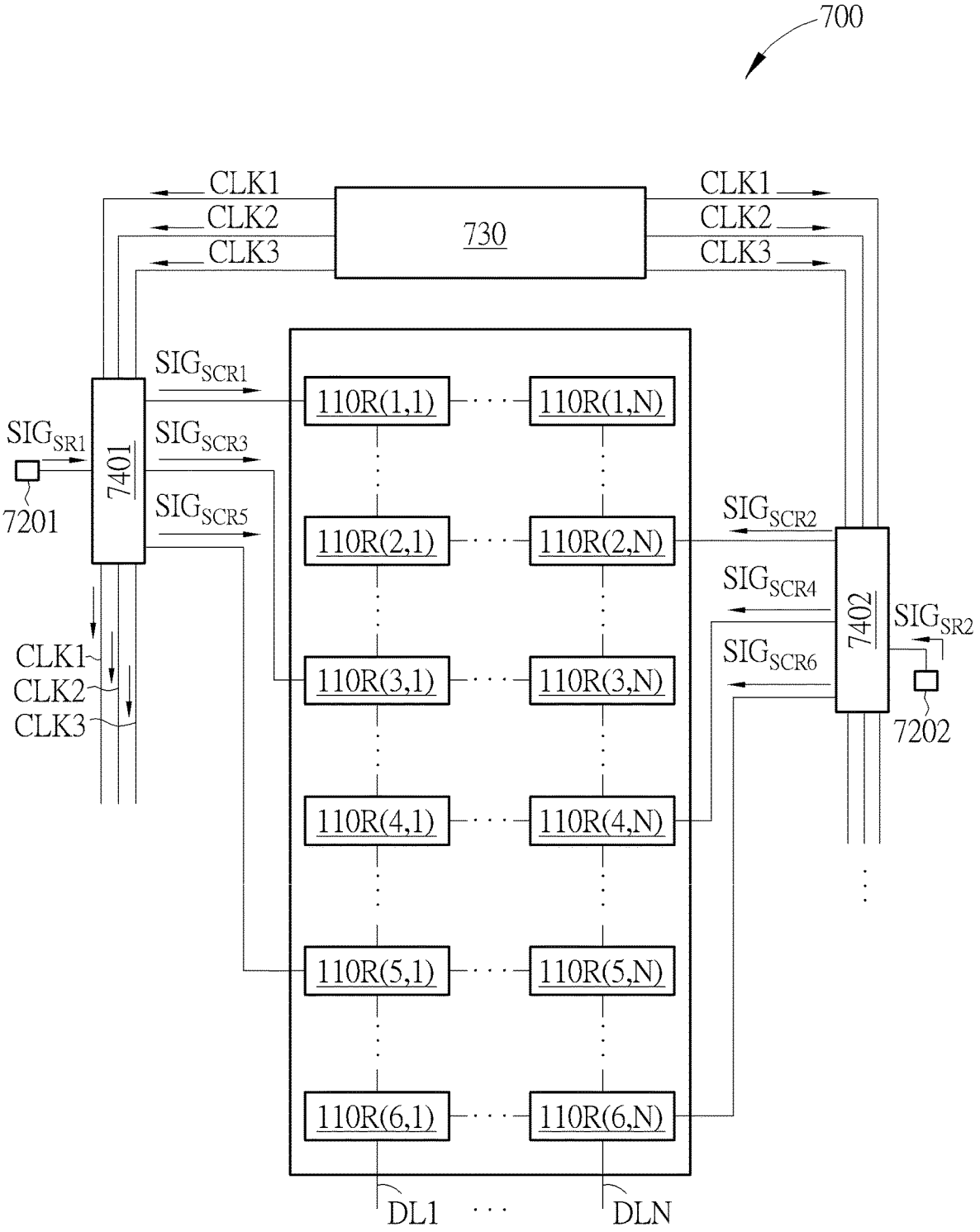
FIG. 13 shows a schematic diagram of an electronic device according to another embodiment of the present disclosure.

FIG. 13 shows a schematic diagram of an electronic device 700 according to another embodiment of the present disclosure. The electronic device 700 and the electronic device 100 have similar structures and can be operated with similar principles. However, the electronic device 700 can further include shift registers 7201 and 7202, a driver circuit 730, and demultiplexers 7401 and 7402. The shift register 7201 can output the first shift signal $SIG_{SR1}$, and the shift register 7202 can output the second shift signal $SIG_{SR2}$. The driver circuit 730 can output clock signals CLK1, CLK2, and CLK3.

In addition, the demultiplexer 7401 can be coupled to the shift register 7201 and the driver circuit 730. The demultiplexer 7401 can receive the first shift signal $SIG_{SR1}$ and output the first scan signals $SIG_{SCR1}$, $SIG_{SCR3}$, and $SIG_{SCR5}$ according to the clock signals CLK1, CLK2, and CLK3 respectively. The demultiplexer 7402 can be coupled to the shift register 7202 and the driver circuit 730. The demultiplexer 7402 can receive the second shift signal $SIG_{SR2}$ and output the first scan signals $SIG_{SCR2}$, $SIG_{SCR4}$, and $SIG_{SCR6}$ according to the clock signals CLK1, CLK2, and CLK3 respectively.

Figure 14:
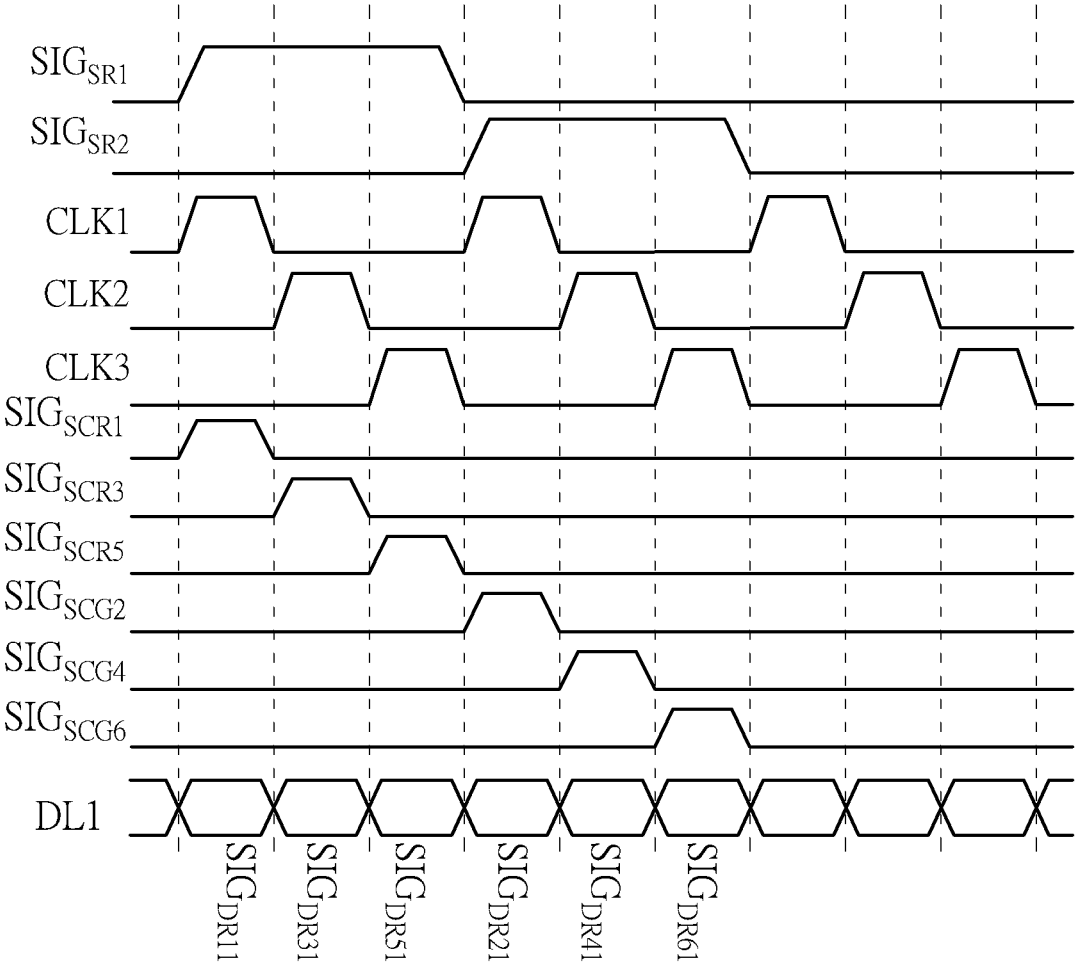
FIG. 14 shows a signal timing diagram of the electronic device in FIG. 13 according to one embodiment of the present disclosure.

FIG. 14 shows a signal timing diagram of the electronic device 700 according to one embodiment of the present disclosure. In FIG. 14, the first shift signal $SIG_{SR1}$ and the second shift signal $SIG_{SR2}$ can be raised to the high voltage sequentially, and are at the high voltage at different periods of time. Also, the clock signals CLK1, CLK2, and CLK3 can be raised to the high voltage sequentially when the shift signals $SIG_{SR1}$ and $SIG_{SR2}$ are at the high voltage. Also, the clock signals CLK1, CLK2, and CLK3 are at the high voltage at different periods of time. However, the order for raising the voltages of the signals is not limited by FIG. 14.

In this case, when the first shift signal $SIG_{SR1}$ is at the high voltage, the demultiplexer 7401 can output the first scan signals $SIG_{SCR1}$, $SIG_{SCR3}$, and $SIG_{SCR5}$ to the first sub pixels 110R(1,1), 110R(3,1), and 110R(5,1) according to the clock signals CLK1, CLK2, and CLK3 respectively. Meanwhile, the data line DL1 would correspondingly transmit the data signals $SIG_{DR11}$, $SIG_{DR31}$, and $SIG_{DR51}$. Similarly, when the second shift signal $SIG_{SR2}$ is at the high voltage, the demultiplexer 7402 can output the first scan signals $SIG_{SCR2}$, $SIG_{SCR4}$, and $SIG_{SCR6}$ to the first sub pixels 110R(2,1), 110R(4,1), and 110R(6,1) according to the clock signals CLK1, CLK2, and CLK3 respectively. Meanwhile, the data line DL1 would correspondingly transmit the data signals $SIG_{DR21}$, $SIG_{DR41}$, and $SIG_{DR61}$.

That is, the electronic device 700 can output six scan signals to the sub pixels of the same color successively, and the data line DL1 can transmit six data signals corresponding to the same color successively, so the power consumption caused by frequent voltage change of the data lines can be reduced. In addition, the designer can also choose the driver circuit 730 properly to generate the desired clock signals according to the system requirement.

In summary, in the electronic devices disclosed by the embodiments of the present disclosure, sub pixels of different colors can be coupled to the same data line, so the electronic device can be manufactured with less data lines, thereby reducing the peripheral circuit required by the electronic device. In addition, the electronic devices provided by the embodiments of the present disclosure can transmit at least two data signals of the same color successively, so the amount and the frequency of the voltage change on the data lines can be reduced, thereby reducing the power consumption.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. An electronic device comprising:

a data line configured to transmit a plurality of data signals;

a plurality of first scan lines intersecting the data line and configured to transmit a plurality of first scan signals;

a plurality of first sub pixels coupled to the data line and configured to emit a first color light; and a plurality of second sub pixels coupled to the data line and configured to emit a second color light different from the first color light;

a plurality of second scan lines intersecting the data line and configured to transmit a plurality of second scan signals;

a plurality of third sub pixels coupled to the data line and configured to emit a third color light different from the first color light and the second color light;

a plurality of third scan lines intersecting the data line and configured to transmit a plurality of third scan signals;

a first shift register configured to output a first shift signal;

a driving circuit configured to output a first clock signal, a second clock signal, and a third clock signal; and a first demultiplexer configured to receive the first shift signal and output one of the plurality of first scan signals according to the first clock signal, one of the plurality of second scan signals according to the second clock signal, and one of the plurality of third scan signals according to the third clock signal, wherein at least two of the plurality of first sub pixels receive at least two of the plurality of data signals successively according to at least two of the plurality of first scan signals and at least two of the plurality of second sub pixels receive at least two of the plurality of data signals successively according to at least two of the plurality of second scan signals.

2. The electronic device of claim 1, wherein the plurality of first sub pixels and the plurality of second sub pixels are arranged in a staggered manner.

3. The electronic device of claim 1, wherein three of the plurality of first sub pixels receive three of the plurality of data signals successively according to three of the plurality of first scan signals.

4. The electronic device of claim 1, wherein the first demultiplexer comprises:

a first transistor having a first terminal configured to receive the clock signal, a second terminal configured to output the one of the at least two of the plurality of first scan signals, and a control terminal coupled to the first shift register; and a second transistor having a first terminal coupled to the second terminal of the first transistor, a second terminal configured to receive a first voltage, and a control terminal configured to receive a pull down control signal.

5. The electronic device of claim 4, wherein the first demultiplexer further comprises:

a third transistor having a first terminal coupled to the first shift register, a second terminal coupled to the control terminal of the first transistor, and a control terminal configured to receive a second voltage; and a capacitor coupled between the control terminal and the second terminal of the first transistor.

6. The electronic device of claim 1, wherein the driving circuit is configured to further output a fourth clock signal and a fifth clock signal;

the first demultiplexer is configured to receive the first shift signal and further output another one of the plurality of first scan signals according to the fourth clock signal and another one of the plurality of second scan signals according to the fifth clock signal.

7. The electronic device of claim 6, wherein:

the first clock signal, the second clock signal, the third clock signal, the fourth clock signal and the fifth clock signal are raised to a high voltage at different periods of time.

8. The electronic device of claim 1, wherein the plurality of first sub pixels, the plurality of second sub pixels, and the plurality of third sub pixels are arranged in a staggered manner, and at least two of the plurality of third sub pixels receive at least two of the plurality of data signals according to at least two of the plurality of third scan signals, and the second shift register is configured to output a second shift signal, wherein the first shift signal and the second shift signal are at a high voltage in different times.

9. The electronic device of claim 8 further comprising:

a second demultiplexer coupled to the second shift register and the driving circuit, wherein:

the driving circuit is configured to further output a fourth clock signal, a fifth clock signal, and a sixth clock signal;

the first demultiplexer is configured to receive the first shift signal and output the at least two of the plurality of first scan signals and one of the at least two of the plurality of second scan signals according to the first clock signal, the second clock signal, and the fourth clock signal; and the second demultiplexer is configured to receive the second shift signal and output another one of the at least two of the plurality of second scan signals and the at least two of the plurality of third scan signals according to the third clock signal, the fifth clock signal, and the sixth clock signal.

10. The electronic device of claim 9, wherein:

the first clock signal, the second clock signal, the third clock signal, the fourth clock signal, the fifth clock signal, and the sixth clock signals are raised to a high voltage at different periods.

11. The electronic device of claim 8 further comprising a second demultiplexer coupled to the second shift register and the driving circuit, wherein:

the driving circuit is configured to further output a fourth clock signal, a fifth clock signal, and a sixth clock signal; and the second demultiplexer is configured to receive the second shift signal and output another one of the at least two of the plurality of first scan signals, another of the at least two of the plurality of second scan signals, and another of the at least two of the plurality of third scan signals according to the fourth clock signal, the fifth clock signal and the sixth clock signal.

12. The electronic device of claim 11, wherein:

the first clock signal, the second clock signal, the third clock signal, the fourth clock signal, the fifth clock signal, and the sixth clock signals are raised to a high voltage at different periods.

13. The electronic device of claim 11, wherein the first shift register and the first demultiplexer are disposed at a first side of the plurality of first sub pixels, and the second shift register and the second demultiplexer are disposed at a second side of the plurality of first sub pixels.

* * * * *